US012135041B2

(12) United States Patent
Arumugam et al.

(10) Patent No.: US 12,135,041 B2
(45) Date of Patent: Nov. 5, 2024

(54) SWIRL FLOW CEILING FAN

(71) Applicants: Narasimma Achari Arumugam, Ashok Nagar (IN); Rajagopal Nandakumar, Ashok Nagar (IN); Thiyagarajan Thirunavukkarasu, Ashok Nagar (IN)

(72) Inventors: Narasimma Achari Arumugam, Ashok Nagar (IN); Rajagopal Nandakumar, Ashok Nagar (IN); Thiyagarajan Thirunavukkarasu, Ashok Nagar (IN)

( * ) Notice: Subject to any disclaimer, the term of this patent is extended or adjusted under 35 U.S.C. 154(b) by 0 days.

(21) Appl. No.: 18/248,976

(22) PCT Filed: Apr. 27, 2022

(86) PCT No.: PCT/IN2022/050397
§ 371 (c)(1),
(2) Date: Apr. 13, 2023

(87) PCT Pub. No.: WO2023/026297
PCT Pub. Date: Mar. 2, 2023

(65) Prior Publication Data

US 2024/0060511 A1 Feb. 22, 2024

(30) Foreign Application Priority Data

Oct. 6, 2021 (IN) ..... 202141045372

(51) Int. Cl.
*F04D 29/54* (2006.01)
*F04D 17/08* (2006.01)
*F04D 29/28* (2006.01)

(52) U.S. Cl.
CPC ..... *F04D 29/542* (2013.01); *F04D 17/08* (2013.01); *F04D 29/281* (2013.01)

(58) Field of Classification Search
CPC ..... F04D 17/08; F04D 29/44; F04D 29/441; F04D 29/54; F04D 29/541; F04D 29/542;
(Continued)

(56) References Cited

U.S. PATENT DOCUMENTS 2,148,254 A * 2/1939 Bergstrom ..... F04D 17/162 415/121.2
2004/0184914 A1* 9/2004 Doege ..... F04D 29/38 415/220

(Continued)

FOREIGN PATENT DOCUMENTS

KR 20110099285 A 9/2011
WO 2023/026297 A1 3/2023

OTHER PUBLICATIONS

Tony Atkins and Marcel Escudier, A Dictionary of Mechanical Engineering, Oxford University Press, 1st Edition, impeller entry. https://www.oxfordreference.com/display/10.1093/acref/9780199587438.001.0001/acref-9780199587438-e-3071 (Year: 2013).*

(Continued)

*Primary Examiner* — Courtney D Heinle
*Assistant Examiner* — Ryan C Clark
(74) *Attorney, Agent, or Firm* — Hamilton, Brook, Smith & Reynolds, P.C.

(57) ABSTRACT

The swirl flow ceiling fan has four major elements. They are: a cylindrical diffuser, an inducer, a stationary enclosure and a safety disc. As the fan rotates, the ambient air is drawn in at the centre. The air which was drawn in by the inducer further gets energised within an enclosed space. The air's velocity gets increased. The charged air is pushed into the numerous spiral compartments of the revolving cylindrical diffuser. Then, finally, the cylindrical diffuser delivers the energised air in to the space. All the features collectively provide a very efficient swirl flow of the air with lesser noise levels and better comfort. It is also found to be cost-effective in its working as well in its manufacturing.

10 Claims, 14 Drawing Sheets

(58) Field of Classification Search
CPC .... F04D 29/281; F04D 25/088; F04D 29/703; F04D 29/442; F04D 29/2255; F24F 13/08; F24F 13/081; F24F 13/082; F24F 13/24; F24F 13/26
See application file for complete search history.

(56) References Cited

U.S. PATENT DOCUMENTS

| | | | | |
|---|---|---|---|---|
| 2007/0177349 | A1* | 8/2007 | Pokharna | F04D 29/703 417/423.1 |
| 2014/0348658 | A1* | 11/2014 | Cunnane | F04D 25/088 416/223 R |
| 2019/0054432 | A1* | 2/2019 | Bachellier | B01F 27/1134 |
| 2019/0242391 | A1 | 8/2019 | Whitmire et al. | |

OTHER PUBLICATIONS

Tony Atkins and Marcel Escudier, A Dictionary of Mechanical Engineering, Oxford University Press, 1st Edition, diffuser entry. https://www.oxfordreference.com/display/10.1093/acref/9780199587438.001.0001/acref-9780199587438-e-1496 (Year: 2013).*

International Search Report for Int'l Application No. PCT/IN2022/050397, entitled Swirl Flow Ceiling Fan, consisting of 2 pages. Date of Mailing: Aug. 11, 2022.

* cited by examiner

SWIRL FLOW CEILING FAN

This application is the U.S. National Stage of International Application No. PCT/IN2022/050397, filed Apr. 27, 2022, which designates the U.S., published in English, and claims priority under 35 U.S.C. § 119 or 365 (c) to Indian application No. 202141045372, filed Oct. 6, 2021. The entire teachings of the above applications are incorporated herein by reference.

FIELD OF INVENTION

The present invention relates to the field of ceiling fans. More specifically, the swirl flow ceiling fan having a rotating diffuser, inducer and a stationary enclosure to provide a uniform thermal distribution within an enclosed space.

BACKGROUND OF INVENTION

Conventional ceiling fans with blades are a fundamental feature of most residential buildings. It also finds its applications in other domains: industries, warehouses, offices, back offices, server rooms, etc. The ceiling fans are mainly used for thermal comfort, better air distribution, better air quality, cost and energy savings.

Humans have used ceiling fans for a very long time for thermal comfort. Thermal comfort is nothing but reducing the skin temperature by forced airflow in a warmer environment. Air movement across the skin carries away the heat from the body to provide comfort.

However, the traditional ceiling fan's comfort zone is limited. It means that persons nearer to the air throw area get the maximum comfort, and as the person moves away from the air throw area, it brings either minimum comfort or none, depending upon the distance.

Therefore, Heating, Ventilation, and Air conditioning (HVAC) systems have come in. They strive to provide uniform air temperature across the room or the area covered under the scheme. However, its energy consumption is relatively very high compared to ceiling fans.

Another aspect of the ceiling fan is providing air distribution parallel with air conditioning systems to enable uniform temperature distribution within an enclosed space. Ventilation for acceptable internal air quality (IAQ), requires outside air. It assumes that the outside air is of good quality. However, most of the time, the ambient air quality is questionable. Insufficiently treated ventilation air makes the IAQ worse. Under these circumstances, effective use of the ceiling fans may reduce the ambient air input. Though the conventional ceiling fans provide better distribution and IAQ, they still lack desired results. Due to its constraint on the air throw area, it calls for some technological advancement.

The available prior art of interest describes various ceiling fans, but none discloses the present invention. The present invention addresses three critical challenges that the users are presently facing. The related art does not reveal any such better solution so far. Firstly, there is a need for a ceiling fan to minimise the thermal distribution within an acceptable range. This will provide better space utilisation and safety of the electronics equipment. Secondly, the ceiling fans shall provide better internal air quality by eliminating stale air and dead air pockets in an enclosed room. Thirdly and finally, the most sought-after attribute of a ceiling fan is the best possible human comfort. It cannot be achieved if the forced air directly contacts the skin or the working surface/desk.

The prior art will be discussed in the sequence of perceived relevance to the present invention.

U.S. Pat. No. 5,192,182, Substantially Noise Less Fan: This prior art consists of a closely spaced plurality of rotatable cylindrical discs. As the disks rotate at a very high speed, the entrapped air within the discs is expelled outward by the centrifugal force. The prior art finds its application to reduce noise levels of heavy-duty bladed fans with heavy-duty driver motor, namely 40HP motor or like, which is impractical for the present invention.

U.S. Pat. No. 7,614,250B2 Centrifugal fan with air guide: This prior art deals with a centrifugal fan for ceiling air conditioners. It also discloses a rotating central hub and a plurality of blades. The hub has holes to guide a certain amount of air to flow near the vicinity of the motor for removing the heat from the surroundings of the motor. The rest of the air is thrown back downwards. The prior art finds its application to aid temperature reduction of the motor. However, the prior art is inadequate to improve the internal air quality or temperature distribution as expected from a better ceiling fan.

U.S. Ser. No. 10/352,325B2 Laminar flow radial ceiling fan: This prior art uses 5 to 8 solid discs. The discs are affixed to a stationary motor and rotate along its central axis. The prior art discloses empty spaces between the discs and a conical central post with concave surfaces to aid laminar flow. The open spaces optionally contain a plurality of air deflectors named vanes. Air gets sucked in and thrown out to the confines without any turbulence. The laminar flow ceiling fans require advancements in order to achieve uniform temperature distribution, better internal air quality, and the best human comfort.

CN111442379 Laminar flow fan and ceiling type air conditioner indoor unit: This prior art provides a laminar flow fan for a ceiling-type air conditioner indoor unit. It has a plurality of annular disks, and they are arranged in parallel at intervals, fixedly connected and arranged with collinear axes; the motor is used for driving the plurality of annular disks to rotate to suck outside air into a radial central area of the plurality of annular disks from one axial side of the plurality of annular disks and blow the outside air out along the radial direction of the plurality of annular disks; at least part of the surface of the annular disc is provided with a plurality of spherical convex-shaped projections to enhance the turbulent flow and to reduce the inherent noise of the laminar flow fan. Though it is an improvement, the spaced spherical projections have limited scope in converting the laminar flow into the turbulent flow. This prior art is deployed within an enclosed casing of an air conditioner's indoor unit. It is not meant for an independent application as a ceiling fan. The arrangement of a plurality of annular discs has numerous disadvantages. As the number of discs increases, system vibration will also be raised. Another disadvantage is that as the number of annular discs increases, it increases manufacturing and assembly costs.

CN210013837 Laminar flow fan: This prior art provides a laminar flow fan. It also comprises a plurality of annular discs arranged in parallel at intervals and have the same central axis. It has similar kinds of limitations as existing in various other prior arts. The prior art concerning the ceiling fans has numerous challenges to be addressed.

The present invention attempts to solve the challenges, as is seen in the prior art. None of the above inventions and patents, taken either singly or severally in combination, teach the present invention. Therefore, there is a need for an efficient and cost-effective device and method to address the highlighted challenges of the prior art. The present invention provides a simple and elegant solution to the existing state of the art as technical advancement that is also cost-effective. The objects and other advantages of the invention will be apparent from the description.

SUMMARY

The present invention overcomes the problems, as seen from the prior art, namely the higher output and throw and the suitable mixture of air to get to the homogenous temperature across the space in a shorter period. It comprises a cylindrical diffuser, an inducer, and a stationary enclosure. The cylindrical diffuser has a central mounting disc, hyperbolically curved hub, and numerous spiral compartments. The central mounting disc is a connecting platform for both motor and the inducer. The hyperbolically curved hub is provided with multiple involuted webs, and the inducer has numerous vanes. Both the inducer's vanes and the involuted webs are evenly aligned to form a continuous flow path for the air to be drawn into the cylindrical diffuser. The spiral compartments are arranged in a favourable array around the periphery of the hyperbolically curved hub. The stationary enclosure having a plurality of central openings gets fixedly coupled to the stationary element of the motor.

The central openings allow the ambient air inside the fan. The stationary enclosure creates an enclosed space between the involute pathways of the cylindrical diffuser and the stationary enclosure. The ambient air is drawn in as the cylindrical diffuser-inducer starts to revolve at an optimum speed. The air which was drawn in by the inducer further gets energised within this enclosed space. The air's velocity gets increased. The charged air is pushed into the numerous spiral compartments of the revolving cylindrical diffuser. Then, finally, the cylindrical diffuser delivers the air into the space. All the features collectively provide a very efficient swirl flow of the air with lesser noise levels and better comfort. The present invention has a lesser number of parts. It is seen that near-uniform room temperature is achievable within the enclosed space by deploying the present invention. It is also found to be cost-effective in its working and manufacturing. These and other features of the present invention will become readily apparent upon further review of the following specifications and drawings.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention provides a novel approach to the construction of ceiling fans. It aids near uniform temperature distribution within the constrained space, better internal air quality, and better human comfort.

Naturally, heavier, cold air will be at the bottom of any given space, and the hotter air will be at the top. Conventional fans always push the air from the top. It means that the hot air is forced against its nature.

In the present invention, the swirl effect draws the air from the bottom towards the centre, in the axial direction, of the present invention; it gets energised within the present invention and delivered to the space in the radial direction. The principle of working will become apparent from the following description.

Figure 1:
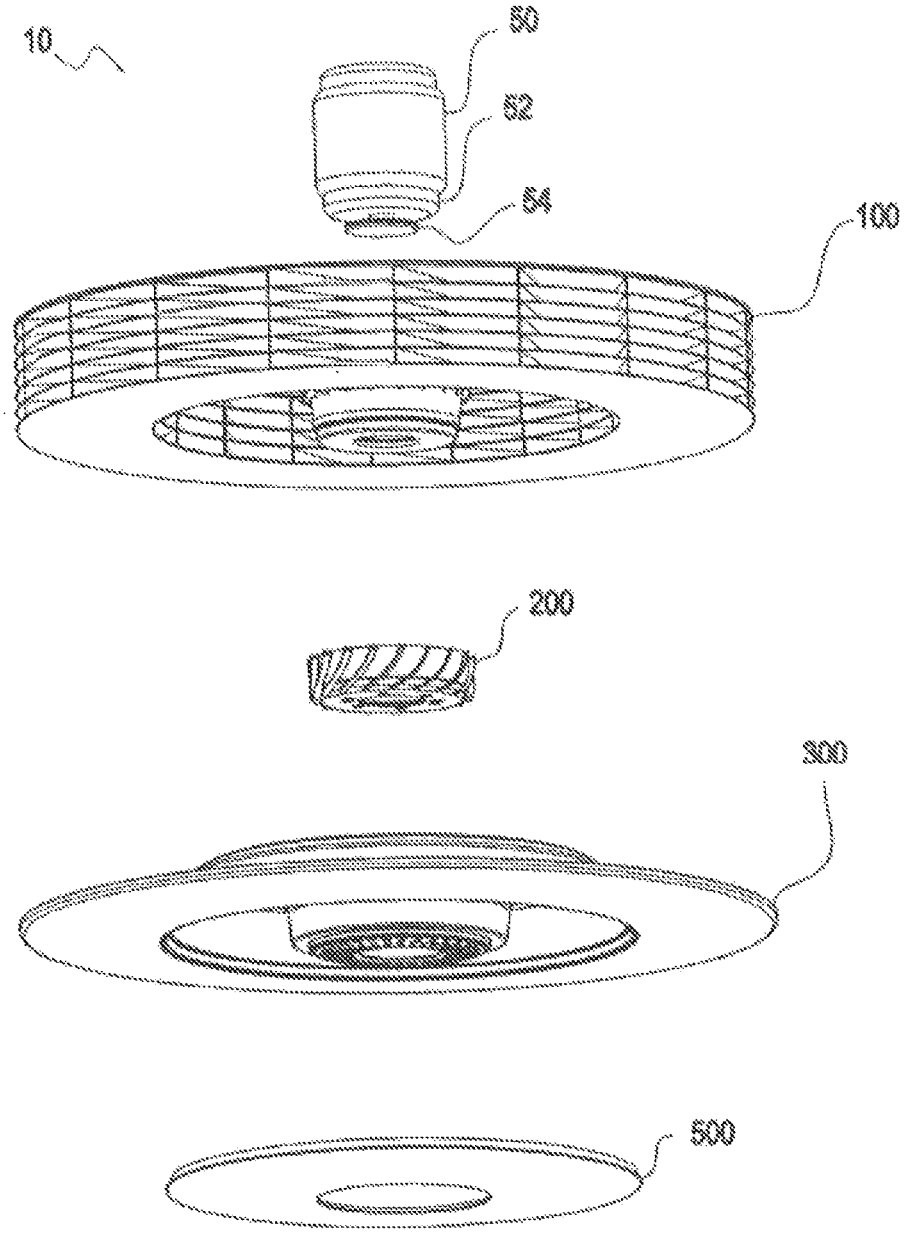
FIG. 1 illustrates the exploded view of the present invention.
Figure 2A:
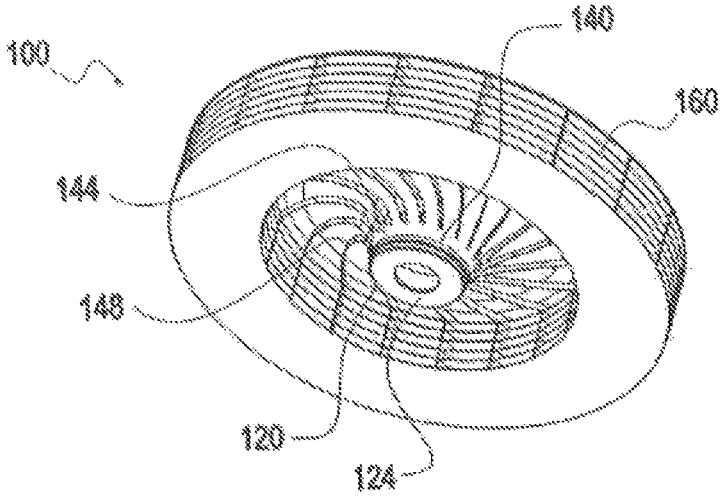
FIG. 2A shows the pictorial view, as viewed from the bottom, of the cylindrical diffuser of the present invention.
Figure 2B:
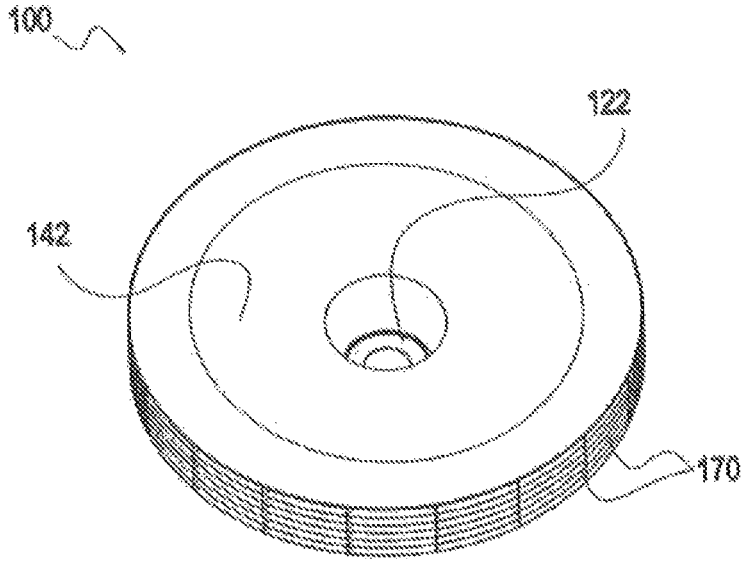
FIG. 2B shows the pictorial view, as viewed from the top, of the cylindrical diffuser.
Figure 2C:
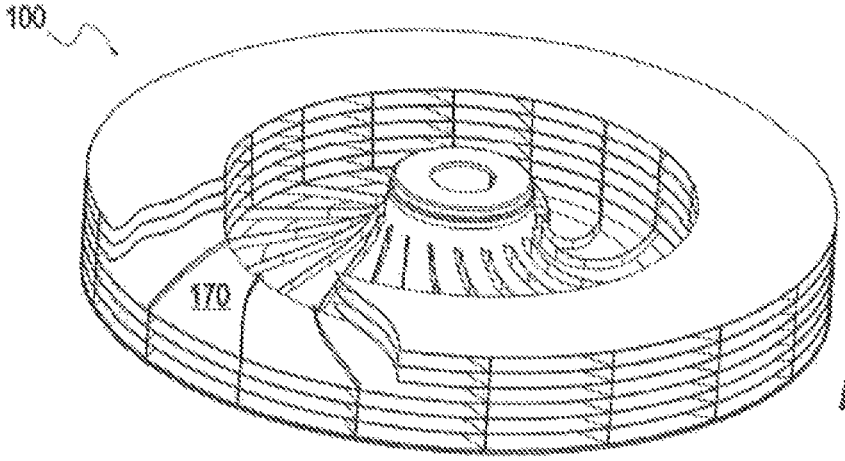
FIG. 2C shows the partly sectioned pictorial view, as viewed from the bottom, of the cylindrical diffuser, indicating the spiral compartments.
Figure 2D:
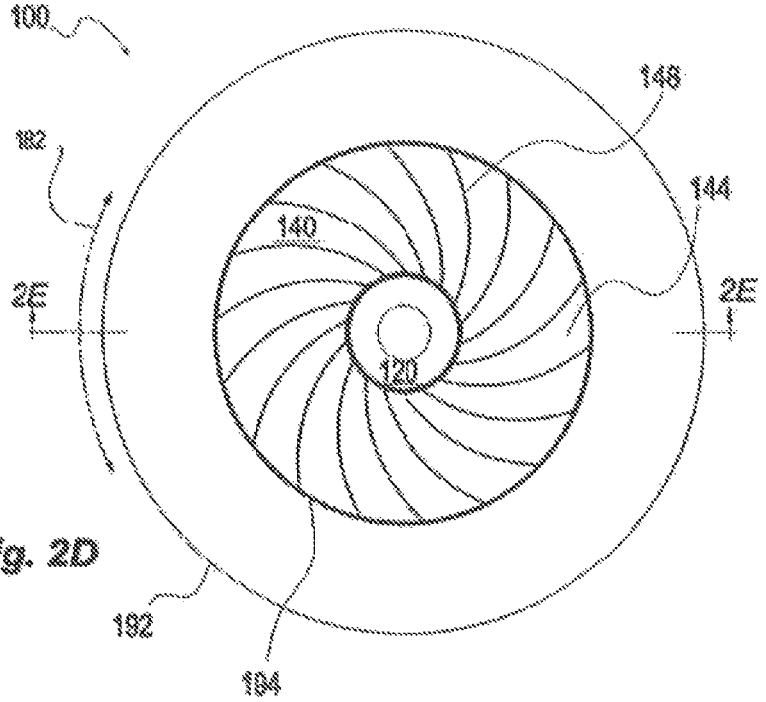
FIG. 2D shows the bottom view showing the involuted pathways at the middle of the cylindrical diffuser.
Figure 2E:
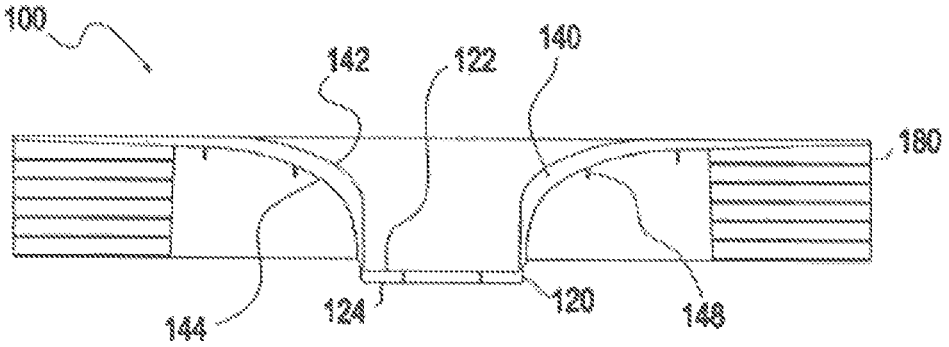
FIG. 2E shows the cross-sectional view of the cylindrical diffuser.
Figure 3A:
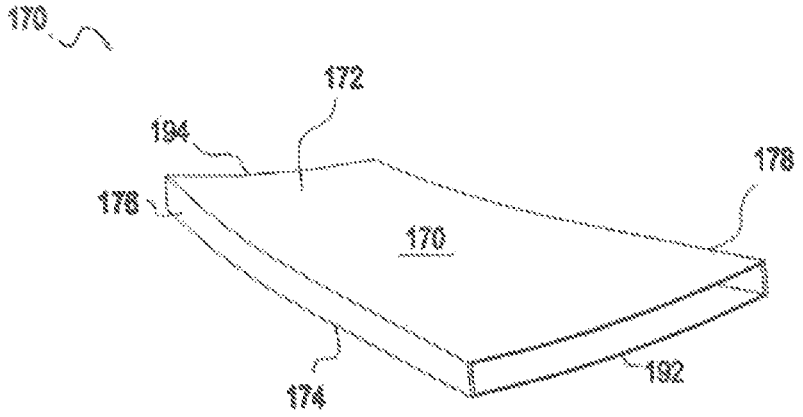
FIG. 3A shows the pictorial view of the spiral compartment.
Figure 3B:
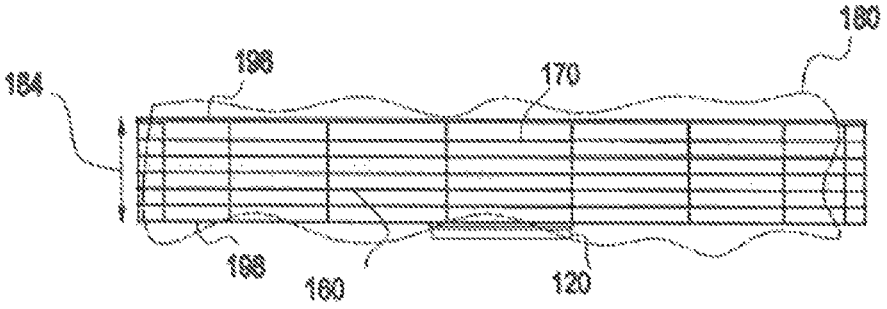
FIG. 3B shows the front view of the cylindrical diffuser.
Figure 3C:
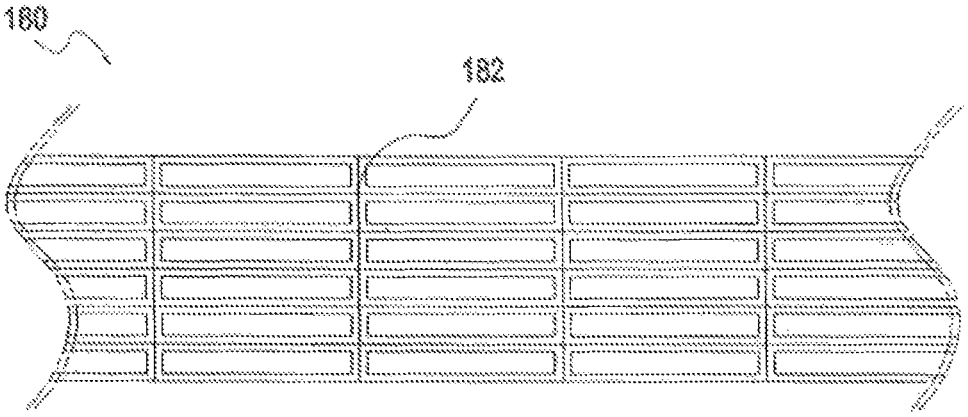
FIG. 3C shows the uniform array of the spiral compartment.
Figure 3D:
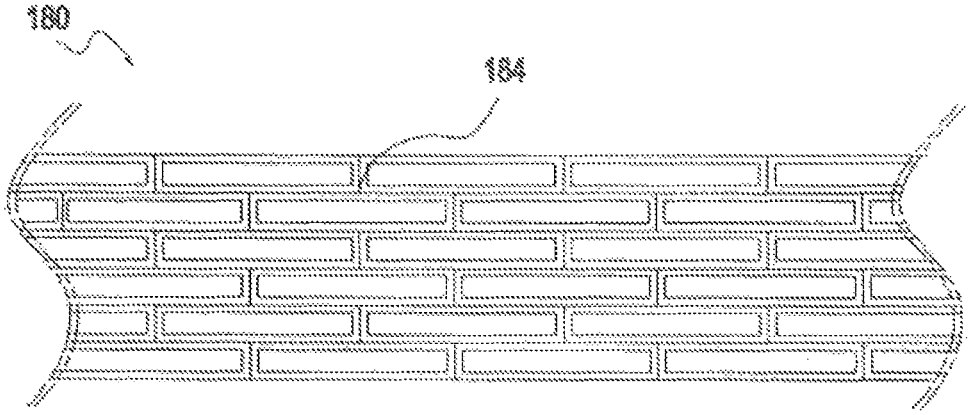
FIG. 3D shows the radially out of phase array of the spiral compartment.
Figure 3E:
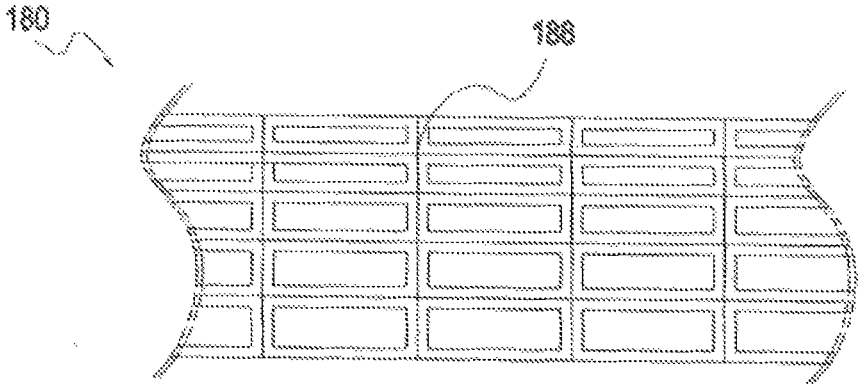
FIG. 3E shows the axially ascending array of the spiral compartment.
Figure 3F:
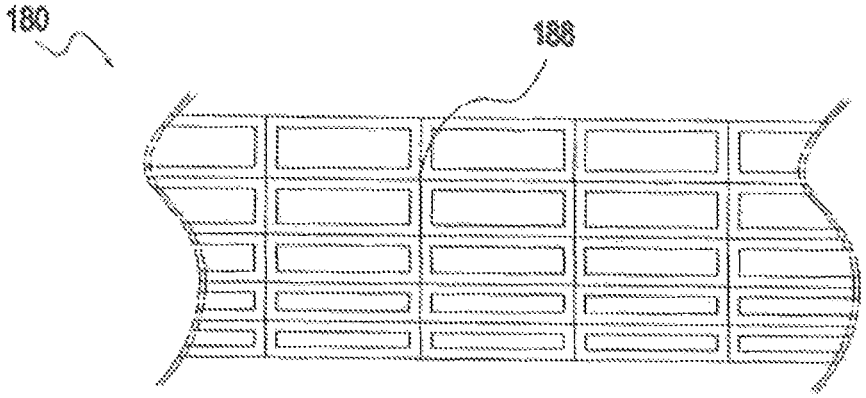
FIG. 3F shows the axially descending array of the spiral compartment.

Referring to FIGS. 1 to 6, the inventive swirl flow ceiling fan is generally referred to by reference number 10. As seen in FIG. 1, it is an exploded view of the swirl flow ceiling fan (10).

As shown in FIGS. 1, 2A-2F, 3A-3F, 4A-B, 5A-D, and 6A-B, the swirl flow ceiling fan (10), comprising a cylindrical diffuser (100) having a central mounting disc (120), the central mounting disc (120) having opposed upper surface (122) and lower surface (124), the upper surface (122) thereof being adapted for fixedly mounting the revolving element (52) of a motor (50), said cylindrical diffuser (100) further having a hyperbolically curved hub (140) extended upwardly from the upper surface (122) of the central mounting disc (120), the hyperbolically curved hub (140) having opposed upper surface (142) and lower surface (144), the lower surface (144) thereof having radially arrayed and outwardly projected plurality of involuted webs (148) therefrom, said cylindrical diffuser (100) further having a plurality of spiral compartments (170) extended radially outward around the hyperbolically curved hub (140) thereof, the plurality of spiral compartments each spiral compartment (170) having left spiral surface (176), right spiral surface (178), top surface (172) and bottom surface (174), the plurality of spiral compartment wherein the spiral compartments (170) integrally stacked into a three-dimensional array (180) in both radial direction (182) and axial direction (184), end-to-end, within the boundaries of two radially opposed outer cylindrical surface (192) and inner cylindrical surface (194) and two axially opposed upper surface (196) and lower (198) surface.

The spiral or the substantially curved profile surfaces (176, 178) enhances the swirl and disrupts the usual laminar flow. The main objective of this plurality of spiral compartments (170) is to give a maximum amount of energy and swirl to the outgoing air such that the air gets stabilised within the constrained space (103) and achieve the uniform temperature at a shorter period of time.

The three-dimensional array (180) of spiral compartments (170) selected from the group consisting of a uniform array (182), radially out-of-phase array (184), axially-ascending-array (186), axially-descending array (188), and any combinations thereof.

The three-dimensional array (180) can be selectively deployed in accordance with the requirements. It is necessary to address the specific requirements of the space in which the present invention (10) is deployed.

For example, if the space, in which the present invention (10) is deployed, has heating elements fixed on the ceiling surface then the axially descending array (188) can effectively be used.

Similarly, the three-dimensional array (180) can be advantageously configured in accordance with the space in which the present invention (10) is deployed.

The cylindrical diffuser (100) is integrally made of a single-piece construction through a near net-shape manufacturing process. Near net-shape manufacturing processes are moulding process, casting process, additive manufacturing process, 3d printing methods, and like processes wherein further post-processing of the produces are very minimal or negligible.

The mounting means for fixedly securing said cylindrical diffuser (100) and the revolving element (52) of the motor (50) is selected from the group consisting of screws, bolts, welds, adhesives and combinations thereof.

Figure 4A:
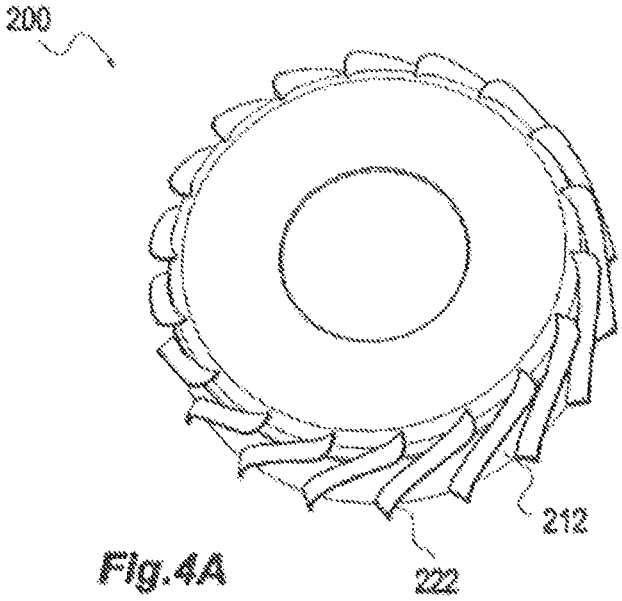
FIG. 4A shows the pictorial view of the inducer, as viewed from the bottom.
Figure 4B:
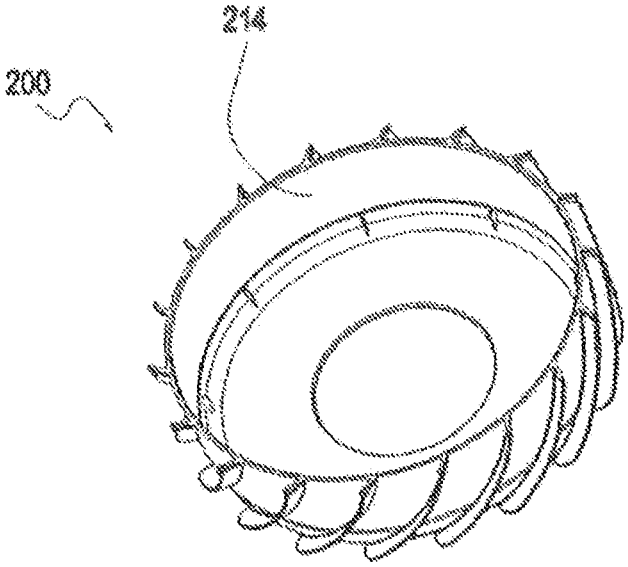
FIG. 4B shows the pictorial view of the inducer, as viewed from the top.
Figure 5A:
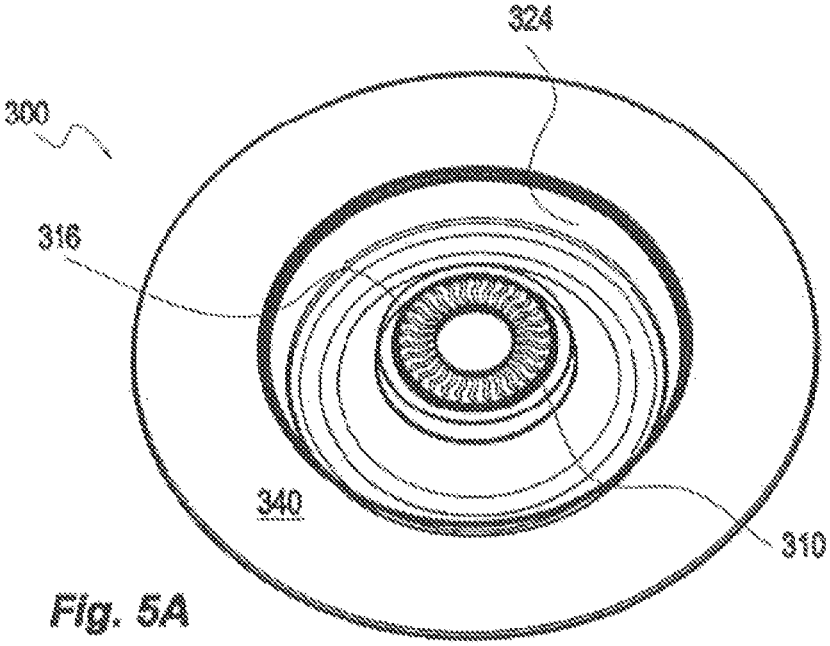
FIG. 5A shows the pictorial view of the stationary enclosure, as viewed from the bottom.
Figure 5B:
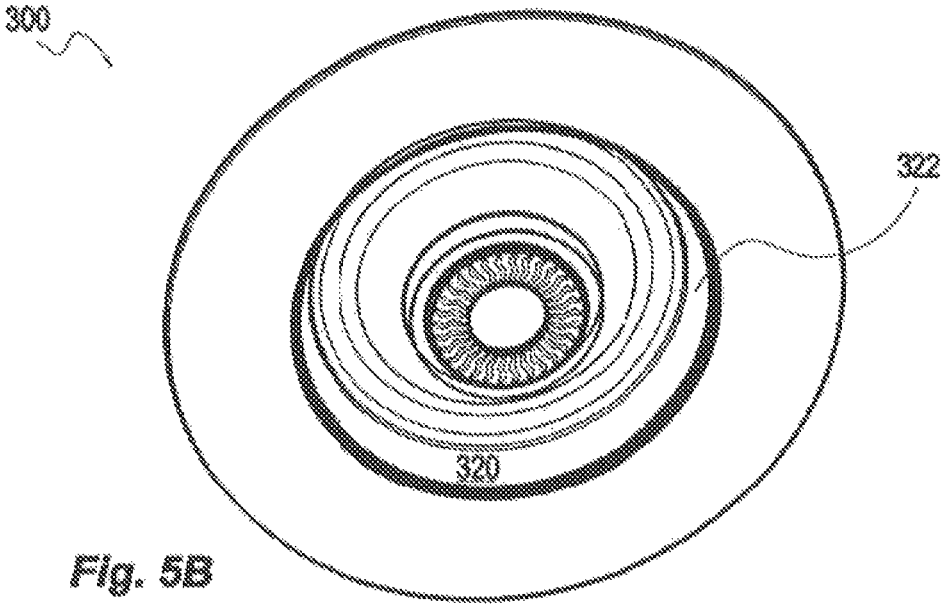
FIG. 5B shows the pictorial view of the stationary enclosure, as viewed from the top.
Figure 5C:
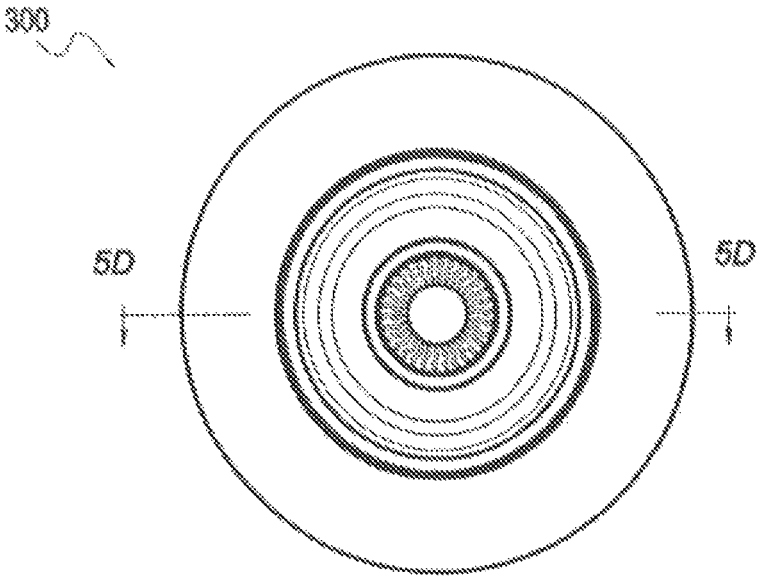
FIG. 5C shows the bottom view of the stationary enclosure.
Figure 5D:
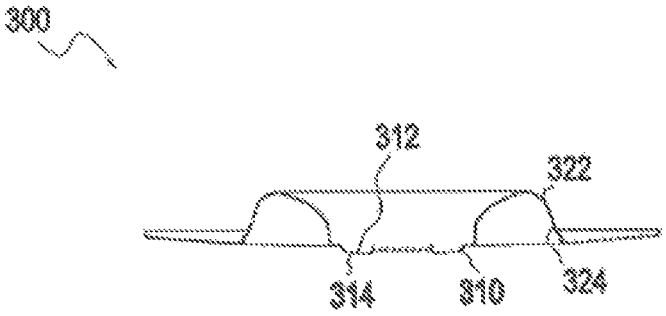
FIG. 5D shows the cross-sectional view of the stationary enclosure.

As shown in FIGS. 4A-B, the inducer (200) has outer surface (212) and inner surface (214). The outer surface (212) of the inducer (200) has radially arrayed and outwardly projected plurality of helical vanes (222) therefrom. The inner surface (214) of said inducer being fixedly secured to the lower surface (124) of said cylindrical diffuser in a manner that it gets extended downwardly from the cylindrical diffuser (100). The plurality of helical vanes (222) of the inducer (200) and the plurality of the involuted webs (148) of the cylindrical diffuser (100) are evenly aligned whereby continuous flow path is formed to draw-in the air while integrally driven by the motor. It means that the cylindrical diffuser (100) and the inducer (200) revolves as single unit.

Alternatively, the cylindrical diffuser (100) and inducer (200) can be integrally made as a single element using any one of the near net-shape manufacturing processes.

The objective of the plurality of helical vanes (222) is to act as a booster to increase the energy of the incoming air and to disrupt the general laminar flow which usually occur as seen in the prior art.

As the cylindrical diffuser (100) and the inducer (200) rotates with high speed it continuously creates a vacuum by throwing the air outside. Thereby, it allows continuous suction of incoming air. The unique combination of the elements so explained herein above provides for the effective swirl flow.

The securement of inducer (200) with the cylindrical diffuser (100) is selected from a group consisting of integral snap locks, screws, bolts, welds, adhesives and combinations thereof. The inducer (200) is integrally made of a single-piece construction through a near net-shape manufacturing process.

As seen from the FIGS. 5A-D, the stationary enclosure (300) has a substantially planar inlet disc (310). The inlet disc has opposed upper surface (312) and lower surface (314). A plurality of openings (316) is formed therethrough for allowing the ambient air in. The stationary enclosure (300) further has a hemi-toroidal ring (320) and a curved annular disc (340). The hemi-toroidal ring (320) is extended upwardly from the inlet disc (310). The curved annular disc (340) is extended radially outward around the hemi toroidal ring (320). The stationary enclosure (300) is integrally made of a single-piece construction through a near net-shape manufacturing process. The stationary enclosure (300) is removably coupled with fixed element of the motor (54), thereby the stationary enclosure remains stationary. The securement of the stationary enclosure (300) with the fixed element of the motor (50) is selected from a group consisting of screws, bolts, welds, adhesives and combinations thereof.

Figure 6A:
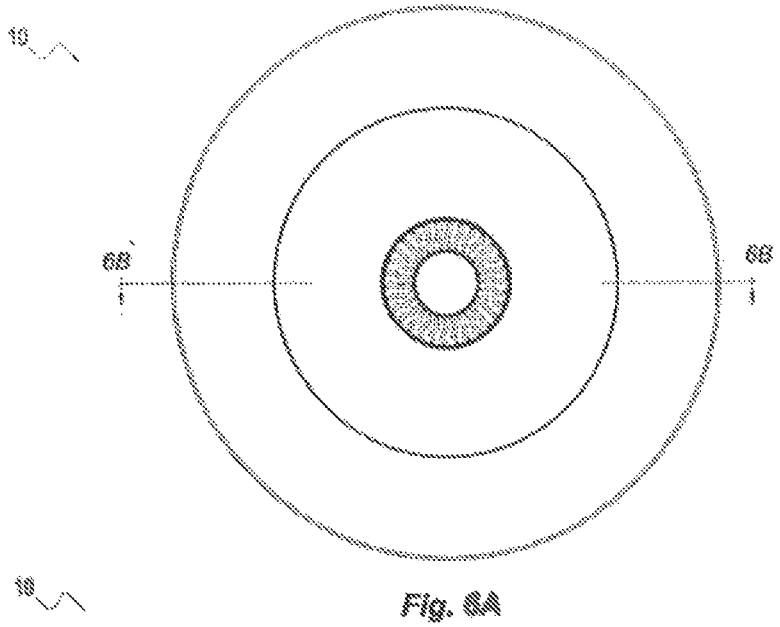
FIG. 6A shows the bottom view of the present invention.
Figure 6B:
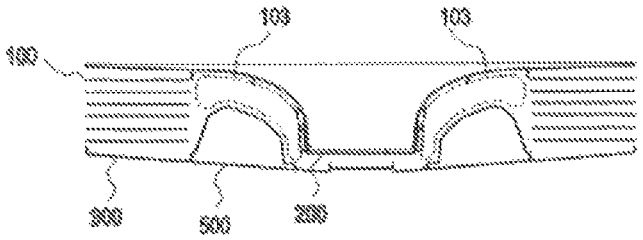
FIG. 6B shows the cross-sectional view of the present invention.

Referring to FIGS. 6A-B, the assembly of the elements the cylindrical diffuser (100), inducer (200) and the stationary enclosure (300) plays a vital role in achieving the objectives of the present invention (10).

The stationary enclosure (300) is another unique feature of the present invention (10). When the stationary enclosure (300) and the cylindrical diffuser (100) are assembled, as shown in the FIGS. 6A-B, it forms a very constricted enclosed space (103). As the cylindrical diffuser (100)-inducer (200) assembly starts to revolve at an optimum speed the ambient air is drawn in. The incoming air gets trapped within the constricted enclosed space (103) for a brief pause.

The air which was forcefully drawn-in by the inducer (300) and trapped within the constricted enclosed space (103) further gets energised. The combination of the hyperbolically curved lower surface (124), the plurality of involuted webs (148), and the curved toroidal upper surface (322) of the hemi-toroidal ring (320) serves the objective of agitating and mixing of the trapped air. The air's velocity gets increased. It further enhances the swirl energy.

The energised air is pushed into the numerous spiral compartments (170) of the revolving cylindrical diffuser (100).

Figure 7:
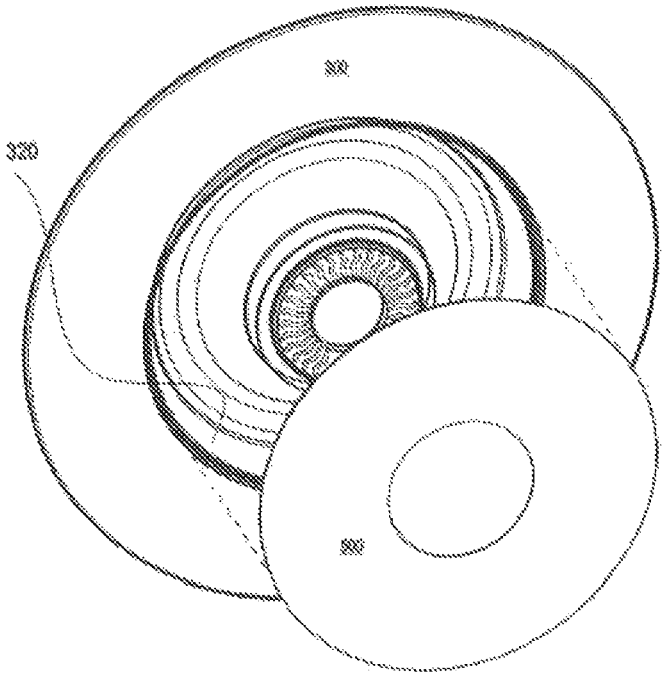
FIG. 7 shows the exploded view of the stationary enclosure and the safety disc.
Figure 8A:
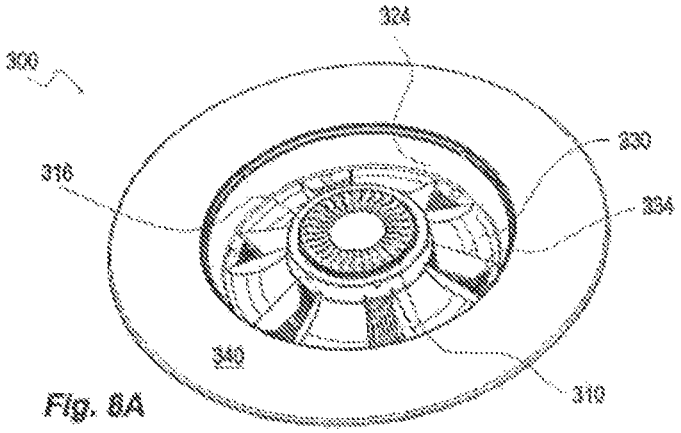
FIG. 8A shows the pictorial view of another embodiment of the stationary enclosure, as viewed from the bottom.
Figure 8B:
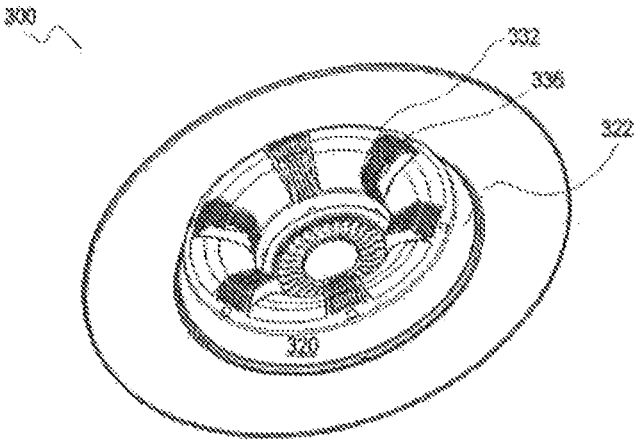
FIG. 8B shows the yet another pictorial view of another embodiment of the stationary enclosure, as viewed from the top.
Figures 8C, 8D:
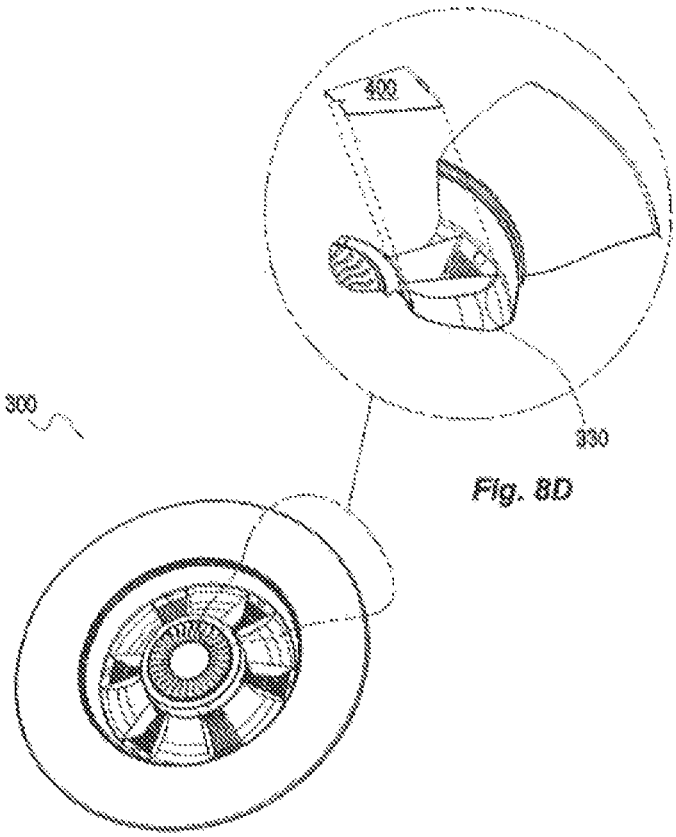
FIG. 8C shows the pictorial view of the another embodiment of stationary enclosure.
FIG. 8D shows the detailed and exploded view of the stationary enclosure and the securing cap.

Then, finally, the cylindrical diffuser (100) delivers the completely charged air in to the space in which the present invention (10) is deployed. All the features collectively provide a very efficient swirl flow of the air with lesser noise levels and better comfort. As seen from the FIG. 7, the stationary enclosure (300) further comprises an optional safety disc (500) adapted for concealing the hemi-toroidal ring (320), and a means for removably securing said safety disc to the stationary enclosure (300). The safety disc (500) is integrally made of a single-piece construction through a near-net-shape manufacturing process. The securement for removably securing said safety disc (500) to the stationary enclosure (300) is selected from the group consisting of integral snap locks, screws, bolts, welds, adhesives, and combinations thereof.

The present invention has a lesser number of parts. It is seen that near-uniform room temperature is achievable within the enclosed space by deploying the present invention (10). It is also found to be cost-effective in its working as well in its manufacturing.

The present invention (10) completely disrupts the normal air flow in a more advantageous way to achieve the objective of near uniform temperature at a shorter period of time in any place in which the present invention is deployed.

Another Preferred Embodiment

In another preferred embodiment, as seen from the FIGS. 8A-D, the hemi-toroidal ring (320) of the stationary enclosure (300) has an opposed upper surface (322) and lower surface (324), wherein a plurality of pockets (330) is formed into said lower surface (324). The plurality of pockets (330) has opposed upper surface (332) and lower surface (334), wherein a plurality of openings (336) is formed therethrough to allow the high-velocity air to pass through. The pockets are removably covered with securing caps (400) for creating an enclosed space. The securement for removably securing said securing cap (400) to the cylindrical diffuser (100) is selected from the group consisting of integral snap locks, screws, bolts, welds, adhesives, and combinations thereof. The securing cap (400) is integrally made of a single-piece construction through a near-net-shape manufacturing process.

The enclosed space created by the pocket is used to accommodate air fresheners and other desired diffusing media. While the fan is in working condition, due to the forced air circulation through the pockets, the air gets sanitized. Then, the sanitized air is guided through the spiral compartments (170) to the desired space.

We claim:

1. A swirl flow ceiling fan, comprising:

a cylindrical element having a central mounting disc, the central mounting disc having opposed upper surface and lower surface, the upper surface thereof being adapted for fixedly mounting the moving element of a motor, said cylindrical element further having a hyperbolically curved hub extended upwardly from the upper surface of the central mounting disc, the hyperbolically curved hub having an opposed upper surface and lower surface, the lower surface thereof having radially arrayed and outwardly projected plurality of involuted webs therefrom, said cylindrical element further having a plurality of spiral compartments extended radially outward around the hyperbolically curved hub thereof, the plurality of spiral compartments each spiral compartment having left spiral surface, right spiral surface, top surface and bottom surface, the plurality of spiral compartment wherein the spiral compartments are integrally stacked into a three-dimensional array in both of a radial direction and an axial direction, end-to-end, within the boundaries of two radially opposed outer cylindrical surface and inner cylindrical surface and two axially opposed upper surface and lower surface;

an inducer having an outer surface and inner surface, the outer surface thereof having radially arrayed and outwardly projected plurality of helical vanes therefrom, the inner surface of said inducer being fixedly secured to the lower surface of said cylindrical element, said inducer extending therefrom, the plurality of helical vanes of said inducer and the plurality of involuted webs of said cylindrical element are evenly aligned whereby continuous flow path is formed to draw-in the air while integrally driven by the motor;

a stationary enclosure having a substantially planar inlet disc, the inlet disc having opposed upper surface and lower surface, wherein a plurality of openings is formed therethrough whereby allowing the ambient air in, and the upper surface thereof being adapted for fixedly mounting the stationary element of said motor, said stationary enclosure further having a hemi-toroidal ring extended upwardly from the inlet disc, and a curved annular disc extended radially outward around the outer periphery of the hemi-toroidal ring thereof.

2. The swirl flow ceiling fan as claimed in claim 1, wherein the three-dimensional array of spiral compartments selected from the group consisting of a uniform array, radially out-of-phase array, axially-ascending array, axially-descending array, and any combinations thereof.

3. The swirl flow ceiling fan as claimed in claim 1, wherein said cylindrical element is integrally made of single-piece construction.

4. The swirl flow ceiling fan as claimed in claim 1, wherein said inducer is integrally made of single-piece construction.

5. The swirl flow ceiling fan as claimed in claim 1, wherein said stationary enclosure is integrally made of single-piece construction.

6. The swirl flow ceiling fan as claimed in claim 1, wherein the hemi-toroidal ring of said stationary enclosure, having opposed upper surface and lower surface, wherein a plurality of pockets is formed into said lower surface.

7. The swirl flow ceiling fan as claimed in claim 6, wherein the plurality of pockets is removably secured with a securing cap whereby creates an enclosed space.

8. The swirl flow ceiling fan as claimed in claim 6, wherein the plurality of pockets having an opposed upper surface and lower surface, wherein a plurality of openings is formed therethrough whereby it allows the high-velocity air to pass through.

9. The swirl flow ceiling fan as claimed in claim 7, wherein said securing cap is integrally made of single-piece construction.

10. The swirl flow ceiling fan as claimed in claim 1, wherein the stationary enclosure further comprises a safety disc removably adapted for concealing the hemi-toroidal ring.

* * * * *